US009546074B2

(12) United States Patent
Okamoto et al.

(10) Patent No.: US 9,546,074 B2
(45) **Date of Patent: *Jan. 17, 2017**

(54) ELEVATOR APPARATUS INCLUDING AN ANOMALOUS ACCELERATION DETECTING MECHANISM

(75) Inventors: Kenichi Okamoto, Tokyo (JP); Yoshikatsu Hayashi, Tokyo (JP); Mineo Okada, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 642 days.

This patent is subject to a terminal disclaimer.

(21) Appl. No.: 13/996,873

(22) PCT Filed: Apr. 1, 2011

(86) PCT No.: PCT/JP2011/058431

§ 371 (c)(1),
(2), (4) Date: Jun. 21, 2013

(87) PCT Pub. No.: WO2012/137279

PCT Pub. Date: Oct. 11, 2012

(65) Prior Publication Data

US 2013/0264149 A1 Oct. 10, 2013

(51) Int. Cl.

| | |
|---|---|
| ***B66B 1/28*** | (2006.01) |
| ***B66B 5/06*** | (2006.01) |
| ***B66B 5/04*** | (2006.01) |

(52) U.S. Cl.
CPC .. *B66B 5/06* (2013.01); *B66B 5/04* (2013.01)

(58) Field of Classification Search
CPC ..... B66B 5/04; B66B 5/06
(Continued)

(56) References Cited

U.S. PATENT DOCUMENTS 4,006,799 A * 2/1977 Binder ..... B66B 5/046 187/277
4,083,432 A 4/1978 Lusti
(Continued)

FOREIGN PATENT DOCUMENTS

CN 101311095 A 11/2008
EP 1 995 203 A1 11/2008
(Continued)

OTHER PUBLICATIONS

Combined Office Action and Search Report issued on Jul. 15, 2015 in Chinese Patent Application No. 201180069763.6 with English translation.

(Continued)

*Primary Examiner* — Anthony Salata
(74) *Attorney, Agent, or Firm* — Oblon, McClelland, Maier & Neustadt, L.L.P.

(57) ABSTRACT

In an elevator apparatus, a car is suspended by a suspending device. A braking apparatus applies a braking force to the car by the suspending device. An excessive speed detection level that changes in response to car position is set in an excessive speed monitoring portion. The excessive speed monitoring portion makes the braking apparatus perform a braking operation when car speed reaches the excessive speed detection level. An anomalous acceleration detecting mechanism operates a safety device if acceleration that exceeds a preset set value arises in the car.

5 Claims, 15 Drawing Sheets

(58) Field of Classification Search
USPC ..... 187/247, 373, 374, 391, 393, 294, 293
See application file for complete search history.

(56) References Cited

U.S. PATENT DOCUMENTS

| | | | | | |
|---|---|---|---|---|---|
| 4,318,456 | A * | 3/1982 | Lowry | B66B 5/10 | 187/294 |
| 4,499,974 | A * | 2/1985 | Nguyen | B66B 5/10 | 187/294 |
| 4,565,264 | A * | 1/1986 | Kunii | B66B 5/06 | 187/373 |
| 6,082,498 | A * | 7/2000 | Coste | B66B 1/40 | 187/284 |
| 6,173,813 | B1 * | 1/2001 | Rebillard | B66B 5/06 | 187/287 |
| 6,619,435 | B1 * | 9/2003 | Watzke | B66B 5/04 | 187/350 |
| 7,533,763 | B2 * | 5/2009 | Kattainen | B66B 1/28 | 187/287 |
| 8,631,909 | B2 * | 1/2014 | Draper | B66B 5/06 | 187/373 |
| 8,939,262 | B2 * | 1/2015 | Schienda | B66B 5/06 | 187/287 |
| 2011/0290591 | A1 * | 12/2011 | Spirgi | B66B 5/027 | 187/247 |
| 2013/0220739 | A1 * | 8/2013 | Okada | B66B 5/04 | 187/254 |
| 2015/0041256 | A1 * | 2/2015 | Okada | B66B 5/0031 | 187/254 |
| 2015/0353323 | A1 * | 12/2015 | Shiraishi | B66B 5/04 | 187/266 |

FOREIGN PATENT DOCUMENTS

| | | | |
|---|---|---|---|
| GB | 1 021 552 | | 3/1966 |
| JP | 53 71445 | | 6/1978 |
| JP | 55-27670 | Y2 | 7/1980 |
| JP | 58-119573 | A | 7/1983 |
| JP | 64-22788 | A | 1/1989 |
| JP | 5-319724 | A | 12/1993 |
| JP | 2004-345803 | A | 12/2004 |
| JP | 2005-523859 | | 8/2005 |
| JP | 2006-36426 | A | 2/2006 |
| JP | 2008-19064 | | 1/2008 |
| JP | 4292203 | | 4/2009 |
| JP | 4575076 | | 11/2010 |
| JP | 2012-162374 | | 8/2012 |
| KR | 10-2004-0082375 | A | 9/2004 |
| KR | 10-2005-0072781 | A | 7/2005 |
| WO | WO 00/39016 | | 7/2000 |
| WO | WO 2004/050525 | A1 | 6/2004 |
| WO | 2004 083091 | | 9/2004 |
| WO | WO 2006/106575 | A1 | 10/2006 |
| WO | WO 2010/107409 | A1 | 9/2010 |

OTHER PUBLICATIONS

Korean Office Action issued Nov. 10, 2014, in Korea Patent Application No. 10-2013-7022485 (with English translation).
Japanese Office Action issued Oct. 7, 2014, in Japan Patent Application No. 2013-508641 (with English translation).
The Extended European Search Report issued Oct. 16, 2014, in Application No. / Patent No. 11862923.7-1705 / 2695841.
International Search Report Issued Aug. 2, 2011 in PCT/JP11/58431 Filed Apr. 1, 2011.
U.S. Appl. No. 13/882,369, filed Apr. 29, 2013, Okada, et al.
Office Action issued Jun. 30, 2015 in Japanese Patent Application No. 2013-508641 (with English language translation).
Office Action issued Mar. 29, 2016 in Japanese Patent Application No. 2013-508641 (with English language summary).
Office Action issued in Japanese Application No. 2015-184906 on Jun. 7, 2016 (w/ partial English translation).

* cited by examiner

ELEVATOR APPARATUS INCLUDING AN ANOMALOUS ACCELERATION DETECTING MECHANISM

TECHNICAL FIELD

The present invention relates to an elevator apparatus in which an excessive speed detection level that changes in response to car position is set by an excessive speed monitoring portion.

BACKGROUND ART

In conventional elevator apparatuses, a car buffer and a counterweight buffer are installed in a hoistway lowermost portion. These buffers have a role of braking and stopping a hoisted body (a car or a counterweight) when the hoisted body could not be braked and stopped before the hoistway lowermost portion by braking apparatuses and safety devices. If we let d be the average deceleration during braking by these buffers, Vc be the speed when the hoisted body collides with a buffer, and t be the deceleration time, then braking distance L is expressed by the following expression:

$$L=(1/2)d\times t^2 \quad (1)$$

Now, from Vc−d×t=0, we can assume that the deceleration time t is t=Vc/d to obtain the following expression:

$$L=(1/2)d\times t^2=(1/2)d\times(Vc/d)^2=Vc^2/2d \quad (2)$$

An upper limit is prescribed for the average deceleration d in order to suppress mechanical shock to which the passengers inside the car are subjected during braking and stopping. For this reason, it is necessary to lengthen the braking distance L as the speed Vc at which the hoisted body collides with the buffer increases, and it is necessary to ensure a buffer stroke that is greater than or equal to this braking distance.

In the European Standards (ENs) (EN 81-1:1998 (10.4.3.1)), for example, a buffer stroke that is sufficient to brake and stop a car is required under conditions in which the buffer impact speed Vc (m/s) is 115 percent of the rated speed Vr (m/s), and the upper limit of the average deceleration d (m/s$^2$) is gravitational acceleration g (=9.81 m/s$^2$). Consequently, from Expression (2), the buffer stroke Lst (m) is given by the following expression:

$$\begin{aligned} Lst \geq L &= Vc^2/2\ g \quad (3) \\ &= (1.15^2\times Vr^2)/(2\times 9.81) \\ &\cong 0.0674Vr^2(\mathrm{m}) \end{aligned}$$

A buffer stroke is also prescribed in Japanese building standards laws with similar aims to the ENs.

Now, in conventional mechanical governors, if car speed reaches a first excessive speed detection level (Vos), an overspeed switch is operated such that passage of electric current to a hoisting machine motor is interrupted and a braking apparatus is activated to brake. Rotation of a driving sheave is thereby braked and stopped, making the car perform an emergency stop. If the car speed reaches a second excessive speed detection level (Vtr) that is higher than the first excessive speed detection level, a speed governor rope is gripped to activate a safety device. A braking force is thereby applied directly to the car to make the car perform an emergency stop.

In mechanical governors of this kind, since the overspeed switch is operated, and the speed governor rope is gripped, etc., using a centrifugal force that is generated in proportion to the square of the car speed, the excessive speed detection levels (Vos and Vtr) are constant throughout the hoistway. Because of that, the excessive speed detection levels (Vos and Vtr) are set to levels that exceed the rated speed Vr even in upper and lower terminal portions of the hoistway where the car decelerates during normal running. Consequently, it has been necessary to design the buffer stroke such that "the buffer impact speed is a speed that is higher than the rated speed, and increases as the rated speed increases."

The buffer strokes found using Expression (3) for cases in which the rated speed is 5 m/s (300 m/min) and 10 m/s (600 m/min), for example, are 1.685 m (for the rated speed 5 m/s) and 6.74 m (for the rated speed 10 m/s), respectively.

In high-speed elevator apparatuses, enlargement of the buffer strokes becomes particularly pronounced as the rated speed increases, and the accompanying increases in hoistway space have been problematic.

Conventionally, emergency terminal speed limiting devices have been considered as a method for solving these problems. In emergency terminal speed limiting devices, an excessive speed detection level (Vets) that becomes progressively lower is set in hoistway terminal portions in which a car decelerates during normal running. An anomalous car speed in the hoistway terminal portions early can thereby be detected to enable the buffer stroke to be shortened by reducing buffer impact speed.

In recent years, techniques have also been proposed in which excessive speed detection levels (Vets) are lowered continuously (steplessly) (see Patent Literature 1, for example).

However, in conventional emergency terminal speed limiting devices such as that described above, because the car is made to perform an emergency stop using a braking apparatus when an anomalous speed is detected, in the rare event that the main ropes suspending the car and the counterweight all break, the braking force from the braking apparatus does not act on the car, and the car is not decelerated until the car speed reaches the second excessive speed detection level (Vtr) in the mechanical governor and safety devices are activated.

Because of that, even if conventional emergency terminal speed limiting devices are used to shorten the buffer stroke, the amount of reduction compared to standard buffer strokes is limited, and there is also no change in the relationship that the buffer stroke is lengthened as the rated speed increases.

In European Standard EN 81-1:1998, for example, it is recognized that the buffer stroke is shortened by up to ⅓ of the standard stroke when an emergency terminal speed limiting device is applied to a high-speed elevator that has a rated speed in excess of 4 m/s. In other words, as shown in Expression (3), the standard buffer stroke is 0.0674 Vr$^2$, but when an emergency terminal speed limiting device is used, the buffer stroke becomes 0.0674 Vr$^2$/3 or greater.

Regarding problems such as breakage of the main ropes, countermeasure techniques have been proposed such as stopping operation of the elevator apparatus when even a single main rope breaks. In addition, techniques have also been proposed in which safety devices are activated upon detecting breakage of a main rope (see Patent Literature 2, for example).

CITATION LIST

Patent Literature

[Patent Literature 1]
Japanese Patent No. 4575076 (Gazette)
[Patent Literature 2]
Japanese Patent No. 4292203 (Gazette)

SUMMARY OF THE INVENTION

Problem to be Solved by the Invention

In recent years, since increases in elevator speed are advancing together with increases in building heights, buffer strokes have become several meters even if conventional emergency terminal speed limiting devices are used, and "further shortening of buffer strokes" is being sought. Although in answer to that, in conventional elevator apparatuses such as that shown in Patent Literature 2, safety devices are activated immediately if the braking apparatus that is activated by the emergency terminal speed limiting devices is disabled by breakage of the main ropes, "further shortening of buffer strokes" is difficult to achieve.

The present invention aims to solve the above problems and an object of the present invention is to provide an elevator apparatus that can shorten buffer stroke amply while ensuring safety.

Means for Solving the Problem

In order to achieve the above object, according to one aspect of the present invention, there is provided an elevator apparatus including: a hoisting machine including a driving sheave; a suspending means that is wound around the driving sheave; a car that is suspended by the suspending means so as to be raised and lowered by the hoisting machine; a braking apparatus that applies a braking force to the car by means of the suspending means; an excessive speed monitoring portion in which is set an excessive speed detection level that changes in response to car position, and that makes the braking apparatus perform a braking operation when car speed reaches the excessive speed detection level; a safety device that is disposed on the car; and an anomalous acceleration detecting mechanism that activates the safety device if acceleration that exceeds a preset set value arises in the car.

Effects of the Invention

In an elevator apparatus according to the present invention, because the excessive speed detection level that changes in response to car position is set in the excessive speed monitoring portion, and the braking apparatus is activated to brake by the excessive speed monitoring portion if the car speed reaches the excessive speed detection level, and the safety device is activated by the anomalous acceleration detecting mechanism if the car acceleration exceeds the set value, the car can be stopped by the safety device in the rare event that the suspending means breaks, enabling the buffer stroke to be shortened amply while ensuring safety.

DESCRIPTION OF EMBODIMENTS

Preferred embodiments of the present invention will now be explained with reference to the drawings.

Embodiment 1

Figure 1:
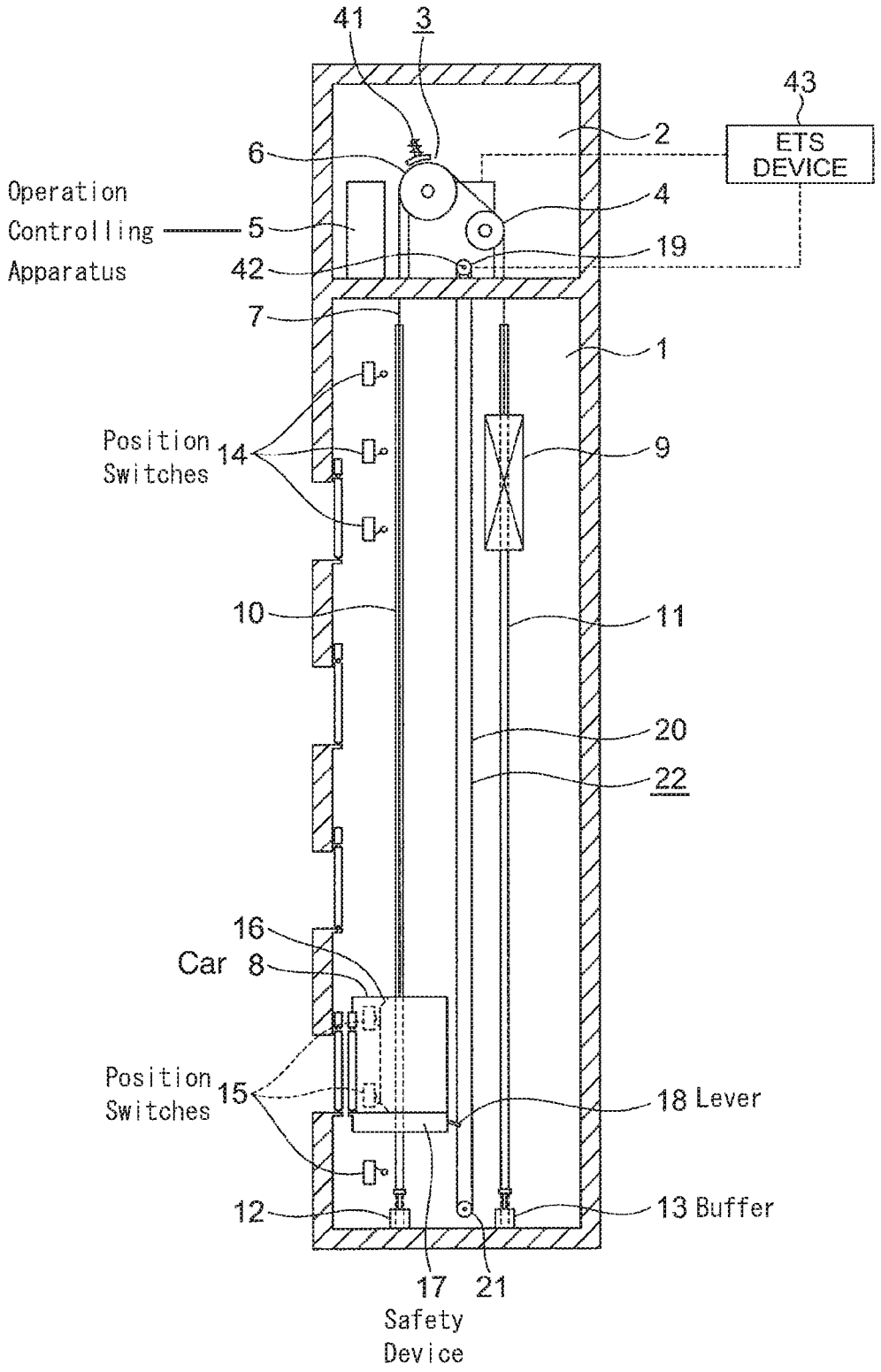
FIG. 1 is a configuration diagram that shows an elevator apparatus according to Embodiment 1 of the present invention.

FIG. 1 is a configuration diagram that shows an elevator apparatus according to Embodiment 1 of the present invention. In the figure, a machine room 2 is disposed in an upper portion of a hoistway 1. A hoisting machine (a driving apparatus) 3, a deflecting sheave 4, and an operation controlling apparatus 5 are installed in the machine room 2. The hoisting machine 3 has: a driving sheave 6; a hoisting machine motor that rotates the driving sheave 6; and a braking apparatus (an electromagnetic brake) 41 that brakes rotation of the driving sheave 6.

The braking apparatus 41 has: a brake wheel (a drum or a disk) that is coupled coaxially to the driving sheave 6; a brake shoe that is placed in contact with and separated from the brake wheel; a brake spring that presses the brake shoe against the brake wheel to apply a braking force; and an electromagnet that separates the brake shoe from the brake wheel in opposition to the brake spring to release the braking force.

A suspending means 7 is wound around the driving sheave 6 and the deflecting sheave 4. A plurality of ropes or a plurality of belts are used as the suspending means 7. A car 8 is connected to a first end portion of the suspending means 7. A counterweight 9 is connected to a second end portion of the suspending means 7.

The car 8 and the counterweight 9 are suspended inside the hoistway 1 by the suspending means 7, and are raised and lowered inside the hoistway 1 by the hoisting machine 3. The operation controlling apparatus 5 raises and lowers the car 8 at a set speed by controlling rotation of the hoisting machine 3.

A pair of car guide rails 10 that guide raising and lowering of the car 8 and a pair of counterweight guide rails 11 that guide raising and lowering of the counterweight 9 are installed inside the hoistway 1. A car buffer 12 that buffers collision of the car 8 into a hoistway bottom portion, and a counterweight buffer 13 that buffers collision of the counterweight 9 into the hoistway bottom portion are installed on the bottom portion of the hoistway 1.

A plurality of (in this case, three) upper car position switches 14 are disposed so as to be spaced apart from each other vertically in a vicinity of an upper terminal floor of the hoistway 1. A plurality of (in this case, three) lower car position switches 15 are disposed so as to be spaced apart from each other vertically in a vicinity of a lower terminal floor of the hoistway 1.

A cam (an operating member) 16 that operates the car position switches 14 and 15 is mounted onto the car 8. The upper car position switches 14 are operated by the cam 16 when the car 8 reaches the vicinity of the upper terminal floor. The lower car position switches 15 are operated by the cam 16 when the car 8 reaches the vicinity of the lower terminal floor.

A safety device 17 that functions as a braking apparatus that makes the car 8 perform an emergency stop by engaging with a car guide rail 10 is mounted onto a lower portion of the car 8. A gradual safety is used as the safety device 17 (gradual safeties are generally used in elevator apparatuses in which rated speed exceeds 45 m/min).

The safety device 17 has: a gripper; a sliding member that generates a braking force by being pushed in between the car guide rail 10 and the gripper; and an activating lever 18 for pushing the sliding member in between the car guide rail 10 and the gripper.

A speed governor 19 that detects an overspeed (an anomalous speed) of the car 8 is installed in the machine room 2. The speed governor 19 has a speed governor sheave, an overspeed detecting switch, a rope catch, etc. An endless speed governor rope 20 is wound around the speed governor sheave. The speed governor rope 20 is set up in a loop inside the hoistway 1. The speed governor rope 20 is wound around a tensioning sheave 21 that is disposed in a lower portion of the hoistway 1.

The speed governor rope 20 is connected to the activating lever 18. Thus, the speed governor rope 20 is cycled when the car 8 is raised and lowered to rotate the speed governor sheave at a rotational speed that corresponds to the running speed of the car 8. A mass 22 according to Embodiment 1 is constituted by the speed governor 19, the speed governor rope 20, and the tensioning sheave 21.

The running speed of the car 8 reaching the overspeed is detected mechanically by the speed governor 19. A first excessive speed detection level Vos that is higher than a rated speed Vr and a second excessive speed detection level Vtr that is higher than the first excessive speed detection level are set in the speed governor 19.

The overspeed detecting switch is operated if the running speed of the car 3 reaches the first excessive speed detection level Vos. When the overspeed detecting switch is operated, power supply to the hoisting machine 3 is interrupted to stop the car 8 urgently using the braking apparatus 41.

If the descent speed of the car 8 reaches the second excessive speed detection level Vtr, the speed governor rope 20 is gripped by the rope catch to stop the cycling of the speed governor rope 20. When the cycling of the speed governor rope 20 is stopped, the activating lever 18 is operated, and the car 8 is made to perform an emergency stop by the safety device 17.

A rotation detector 42 that generates a signal that corresponds to rotation of the speed governor sheave is disposed on the speed governor 19. The signal from the rotation detector 42 is input into an emergency terminal speed limiting device (an ETS device) 43 that functions as an excessive speed monitoring portion. The emergency terminal speed limiting device 43 computes car position and car speed independently from the operation controlling apparatus 5 based on the signal from the rotation detector 42.

An excessive speed detection level Vets that changes in response to car position is set in the emergency terminal speed limiting device 43. The excessive speed detection level Vets is set so as to change steplessly relative to position inside car deceleration zones in hoistway terminal portions.

The emergency terminal speed limiting device 43 monitors whether car speed reaches the excessive speed detection level Vets, and makes the braking apparatus 41 perform a braking operation when car speed reaches the excessive speed detection level Vets. The emergency terminal speed limiting device 43 detects that the car 8 has reached a vicinity of a terminal floor by the car position switches 14 and 15 being operated by the cam 16. The emergency terminal speed limiting device 43 corrects car position information that is obtained from the rotation detector 42 based on absolute position information that is obtained from the car position switches 14 and 15.

The functions of the emergency terminal speed limiting device 43 can be implemented by a microcomputer, for example. The functions of the operation controlling apparatus 5 can be implemented by a microcomputer that is separate from that of the emergency terminal speed limiting device 43.

Figure 2:
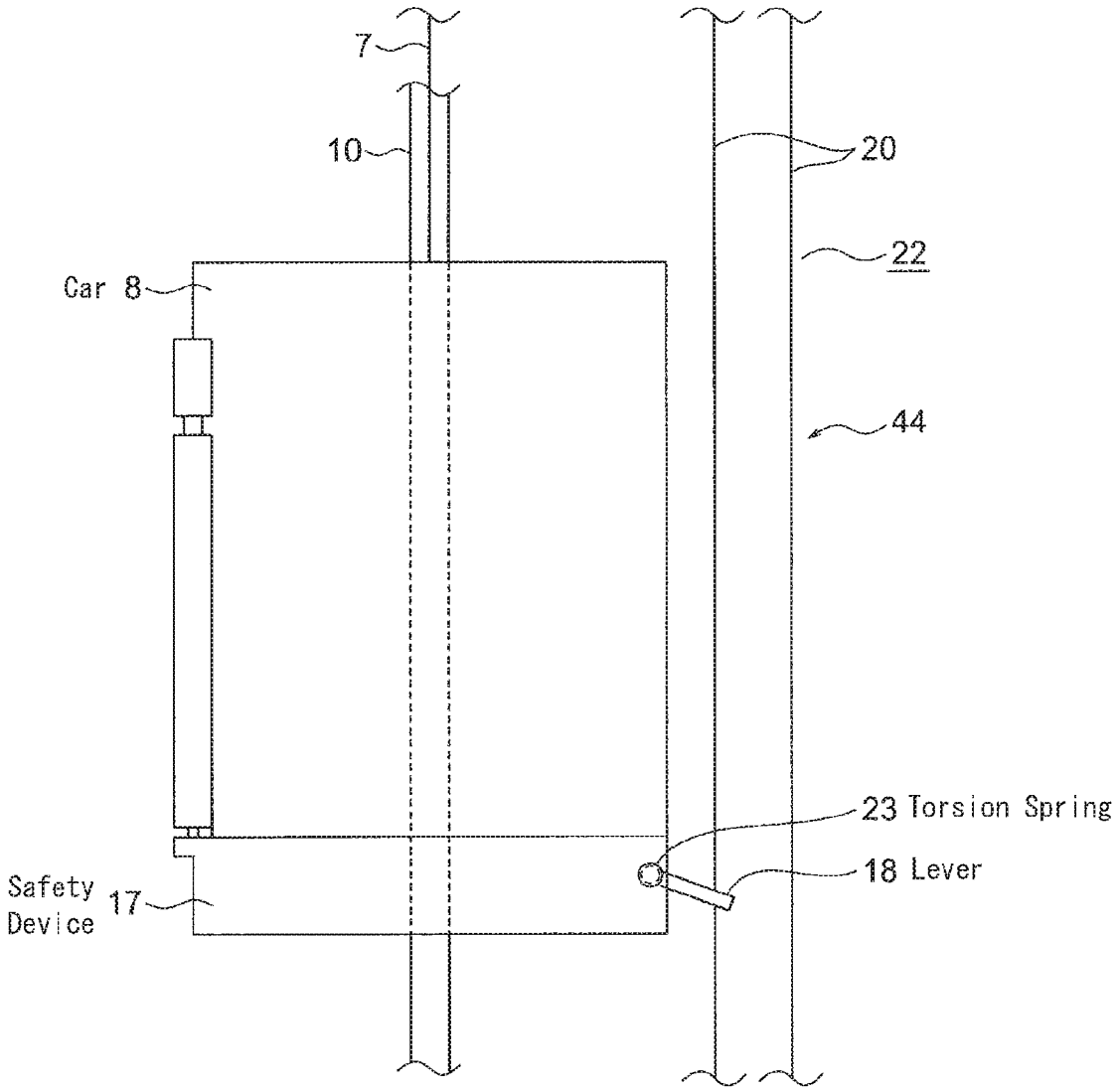
FIG. 2 is a configuration diagram that shows a car from FIG. 1 enlarged.

FIG. 2 is a configuration diagram that shows the car 8 from FIG. 1 enlarged. A torsion spring 23 that applies torque to the activating lever 18 in a direction (counterclockwise in the figure) that is opposite to the direction that activates the safety device 17 is disposed on the pivoting shaft of the activating lever 18. The spring force of the torsion spring 23 is set such that the safety device 17 is not activated in a normal hoisting state. An anomalous acceleration detecting mechanism 44 according to Embodiment 1 includes the mass 22 and the torsion spring 23.

Figure 3:
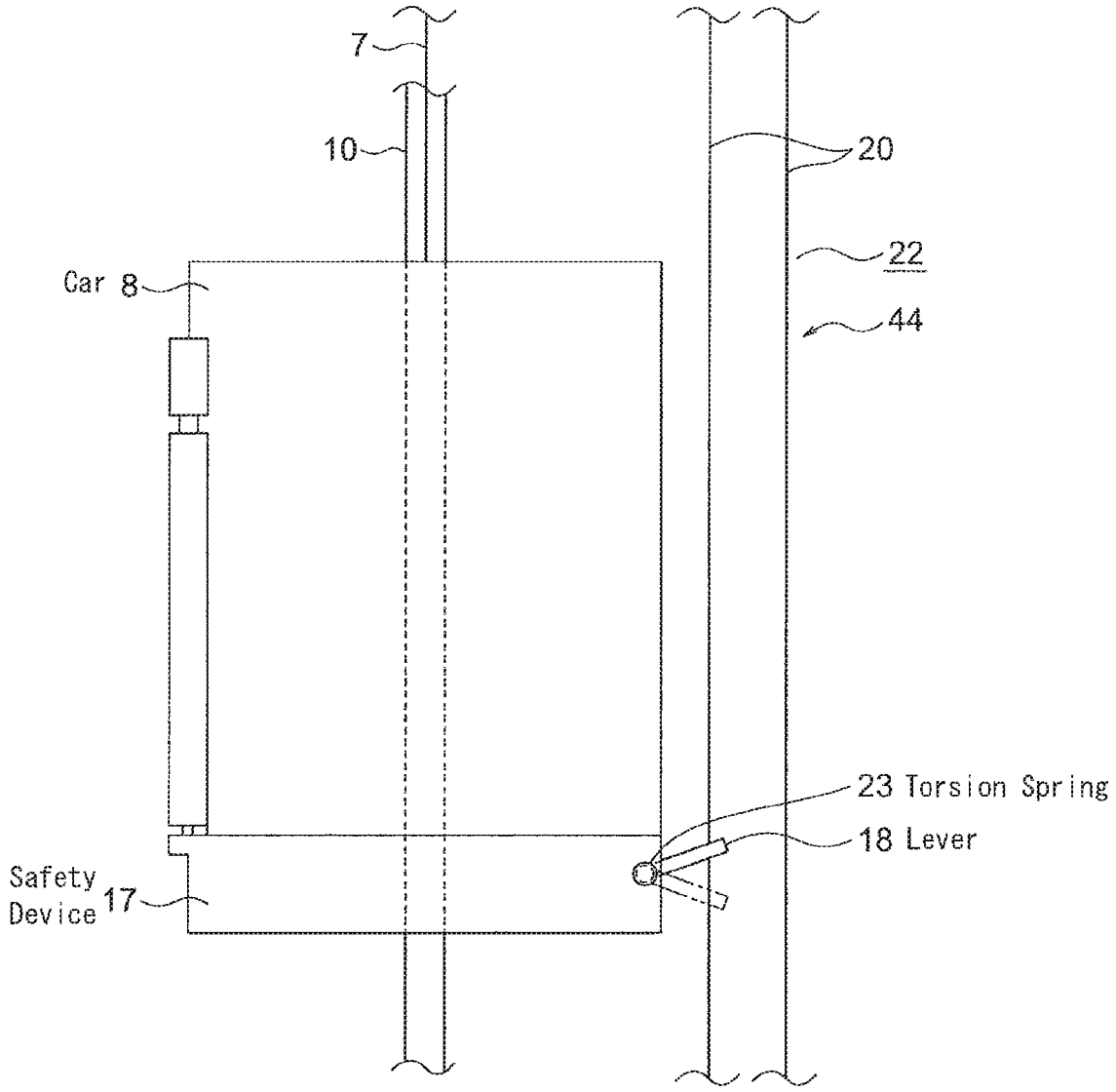
FIG. 3 is a configuration diagram that shows a state in which an activating lever from FIG. 2 is pivoted.

The activating lever 18 is pivoted counterclockwise (lifted) as shown in FIG. 3 in opposition to the torque of the torsion spring 23 and the weight of the activating lever 18 and other parts (not shown) of the safety device 17 when a force that exceeds Fs (N) in magnitude is applied upward at the position at which the speed governor rope 20 is attached, and is adjusted such that the safety device 17 is activated thereby.

The mass of the speed governor rope 20 is Mr (kg), the inertial mass of the speed governor 19 at the diameter around which the speed governor rope 20 is wound is Mg (kg), and the inertial mass of the tensioning sheave 21 at the diameter around which the speed governor rope 20 is wound is Mh (kg). That is, the inertial mass Mt (kg) of the mass 22 at the position of the activating lever 18 is:

$$Mt=Mr+Mg+Mh \quad (4)$$

Now, if the suspending means 7 breaks and the car 8 accelerates at an acceleration g ($m/s^2$), then the car 8 is subjected to an inertial force Fp (N) from the mass 22 that has a magnitude of:

$$Fp=Mt\times g \quad (5)$$

upward at the activating lever 18. Thus, by setting this inertial force Fp (N) so as to be greater than or equal to the force Fs (N) that is required to activate the safety device 17, it is possible to activate the safety device 17 if the suspending means 7 breaks and the car 8 falls, even if the speed governor 19 has not detected a speed that is greater than or equal to the second excessive speed detection level Vtr. The following expression is the condition for activating the safety device 17 by the inertial force that acts on the mass 22:

$$Fp=Mt\times g>Fs \quad (6)$$

Thus, if acceleration that exceeds a preset set value arises in the car 8 due to breakage of the suspending means 7, etc., the anomalous acceleration detecting mechanism 44 activates the safety device 17 without supplying electricity using the force that is generated by the mass 22, to apply a braking force to the car 8 directly. Power supply to the hoisting machine 3 is also interrupted when the safety device 17 is activated by the anomalous acceleration detecting mechanism 44.

Moreover, in Embodiment 1, the acceleration that generates the inertial force has been explained assuming gravitational acceleration g when the car 8 free-falls due to breakage of the suspending means 7, but a car acceleration a at which the safety device 17 is activated can also be adjusted by adjusting the setting of the force Fs that is required to activate the safety device 17 or the setting of the inertial mass Mt that generates the inertial force Fp. The conditions for activating the safety device 17 in that case are given by the following expression:

$$Fp=M\times\alpha>Fs \quad (6')$$

Next, a car acceleration anomaly detecting operation by the anomalous acceleration detecting mechanism 44 will be explained. If the suspending means 7 breaks and the car 8 free-falls (at acceleration g) while the car 8 is moving at speed V0, acceleration ΔVis of the car 8 from breakage of the suspending means 7 until the safety device 17 is activated can be expressed by the following expression, where $\Delta t_{is}$ is the delay until the safety device 17 is activated:

$$\Delta Vis=g\times\Delta t_{is} \quad (7)$$

Figure 4:
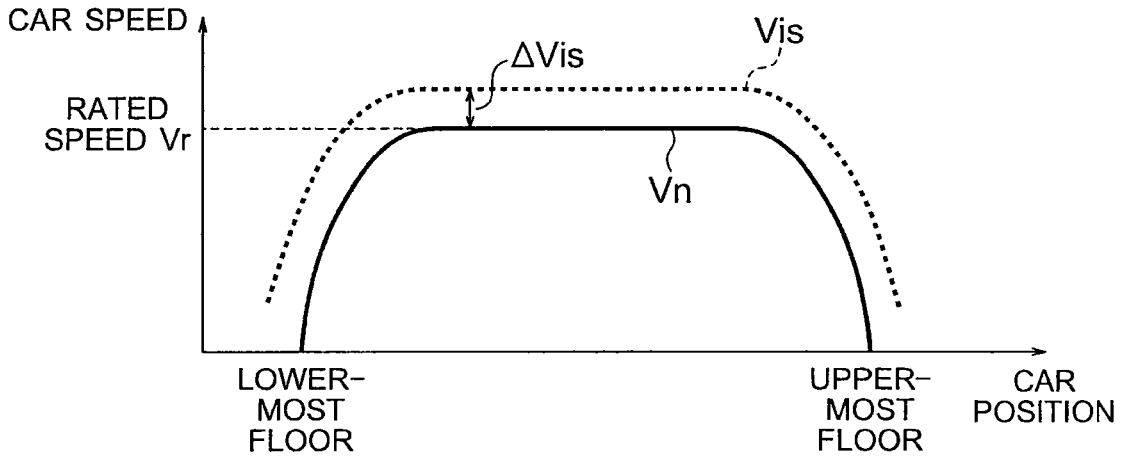
FIG. 4 is a graph that shows a relationship between an equivalent excessive speed detection level by an anomalous acceleration detecting mechanism from FIG. 2 and car position.

Now, FIG. 4 is a graph that shows a relationship between an equivalent excessive speed detection level Vis by an anomalous acceleration detecting mechanism 44 from FIG. 2 and car position. Solid line Vn is a normal running pattern (normal speed pattern) of the car 8 during normal running from the upper terminal floor to the lower terminal floor such that maximum speed is set to the rated speed Vr. The equivalent excessive speed detection level Vis replaces anomalous acceleration that is detected by the anomalous acceleration detecting mechanism 44 with an anomaly detection speed.

If the car 8 free-falls due to breakage of the suspending means 7, and the car acceleration becomes greater than or equal to a set value, the above inertial force Fp becomes greater than Fs, and the safety device 17 is activated. As shown in FIG. 4, the anomaly detection speed in this instance is a pattern that is approximately parallel to the normal running pattern Vn so as to be separated by a distance equivalent to the acceleration of the car ΔVis from the normal running pattern.

An excessive speed detection level Vets to which a first excessive speed detection level (Vos) by the mechanical governor 19 is changed in response to car position in hoistway terminal portions is set in the emergency terminal speed limiting device 43. In contrast to that, the equivalent excessive speed detection level Vis that is shown in FIG. 4 has similar or identical effects to changing the second excessive speed detection level (Vtr) in the mechanical governor 19 in response to the car position in the hoistway terminal portions (Vis).

Whereas the relationship between Vos and Vtr in the mechanical governor 19 is always Vos<Vtr, the magnitude relationship between Vets and Vis does not necessarily have to be Vets<Vis.

Figure 5:
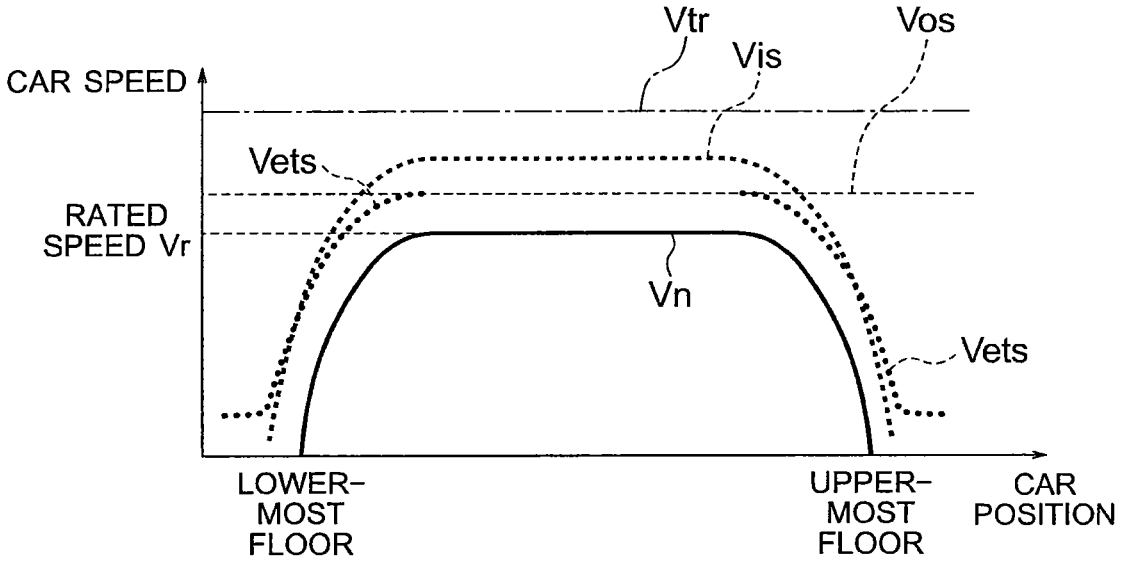
FIG. 5 is a graph that shows an example of a set state of an excessive speed detection level in the elevator apparatus in FIG. 1.

FIG. 5 is a graph that shows an example of a set state of an excessive speed detection level in the elevator apparatus in FIG. 1. In FIG. 5, the equivalent excessive speed detection level Vis by the anomalous acceleration detecting mechanism 44 intersects the excessive speed detection level Vets by the emergency terminal speed limiting device 43. However, even if the equivalent excessive speed detection level Vis is lower, because the anomalous acceleration detecting mechanism 44 operates only when a given acceleration level is exceeded, the anomalous acceleration detecting mechanism 44 will not operate before the emergency terminal speed limiting device 43 in a state in which the braking by the braking apparatus 41 is enabled during increases in car speed due to control runaway of the hoisting machine motor, for example.

Because of that, it is preferable for the anomalous acceleration detection level of the anomalous acceleration detecting mechanism 44 to be set so as to be higher than acceleration due to control runaway of the hoisting machine motor, and lower than acceleration during breakage of the suspending means 7. In this manner, even if the excessive speed detection level Vis and the excessive speed detection level Vets have a relationship that intersects as shown in FIG. 5, and even if the excessive speed detection level Vis is set to a level that is lower than the second excessive speed detection level Vtr by the mechanical speed governor 19, the safety device 17 will not be activated needlessly and placed in a state that requires time to restore under conditions that can be braked by the braking apparatus 41, not to mention during a normal running state.

Figure 6:
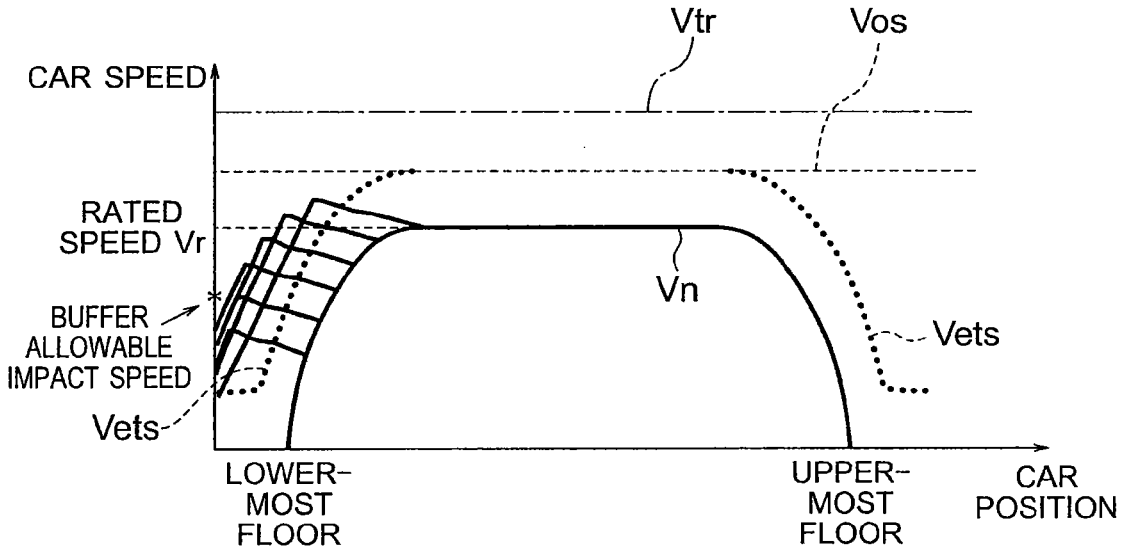
FIG. 6 is a graph that shows emergency braking behavior during excessive speed detection by an emergency terminal speed limiting device from FIG. 1.

FIG. 6 is a graph that shows emergency braking behavior during excessive speed detection by an emergency terminal speed limiting device 43 from FIG. 1. In the case of a car speed anomaly due to control runaway of the hoisting machine motor, passage of electric current to the hoisting machine motor is interrupted by the emergency terminal speed limiting device 43 at a point at which the car speed reaches the excessive speed detection level Vets, and the braking apparatus 41 is activated to brake and make the car 8 perform an emergency stop.

At this point, because there is a slight delay before the braking force from the braking apparatus 41 is applied, car speed is not decelerated immediately even after the excessive speed detection level Vets is exceeded. The closer the occurrence of the car speed anomaly is to a rated speed running zone midway along the hoistway, the higher the excessive speed detection level Vets, but the longer the distance to reach a buffer upper surface (a position on the vertical axis in FIG. 6). Because of that, it can be seen that if the speed during anomaly detection is greater than or equal to a given speed, the buffer impact speed when performing emergency braking is reduced.

Figure 7:
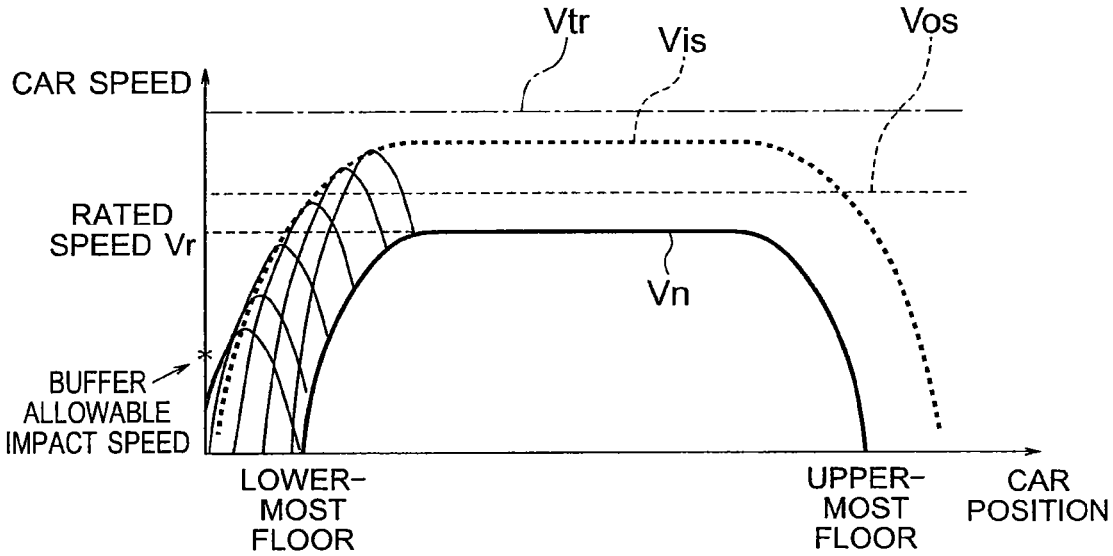
FIG. 7 is a graph that shows emergency braking behavior during excessive speed detection by the anomalous acceleration detecting mechanism from FIG. 2.

Next, FIG. 7 is a graph that shows emergency braking behavior during excessive speed detection by the anomalous acceleration detecting mechanism 44 from FIG. 2. In the rare event that the suspending means 7 breaks, if acceleration that exceeds a threshold level arises, deceleration by the safety device 17 is started by the inertial force thereof. The equivalent excessive speed detection level Vis indicates the operation commencement timing of the anomalous acceleration detecting mechanism 44. In a similar manner to that of emergency braking behavior during excessive speed detection by the emergency terminal speed limiting device 43, the closer the occurrence of the car speed anomaly is to a rated speed running zone midway along the hoistway, the higher the equivalent excessive speed detection level Vis, but the longer the distance to reach a buffer upper surface. Because of that, it can be seen that if the speed during anomaly detection is greater than or equal to a given speed, the buffer impact speed when performing emergency braking is reduced.

In an elevator apparatus of this kind, because an anomalous acceleration detecting mechanism 44 that uses force that is generated by a mass 22 to make a safety device 17 perform a braking operation if acceleration that exceeds a preset set value arises in a car 8 is used in addition to the emergency terminal speed limiting device 43, it is possible to apply a braking force to decelerate and stop the car even in the rare event that the suspending means 7 breaks.

If a plurality of excessive speed detection levels are set in the emergency terminal speed limiting device 43, and a braking means that corresponds to at least one excessive speed detection level is a braking means (a safety device 17) that applies a braking force directly to the car 8, then the car 8 can be decelerated and stopped even when the suspending means 7 is broken. However, the anomalous acceleration detecting mechanism 44 according to Embodiment 1 detects anomalies earlier by detecting excessive acceleration instead of excessive speed, enabling the car 8 to be decelerated and stopped.

In other words, if a plurality of excessive speed detection levels are set in the emergency terminal speed limiting device 43, then a second excessive speed detection level at which braking force is applied directly to the car 8 is set to a speed level that is higher than a first excessive speed detection level at which braking force is applied by means of the suspending means 7. Because of that, car speed anomaly detection delay is increased.

In contrast to that, if an acceleration anomaly is detected by the anomalous acceleration detecting mechanism 44 according to Embodiment 1, anomaly detection is enabled before the car speed becomes high when the suspending means 7 is broken, etc. Because of that, detection delay is reduced, and decelerating operation is started early. Consequently, the car speed on arrival at a buffer upper surface can be kept lower, enabling shortening effects on larger buffer strokes to be achieved.

In addition, several methods for adding a function to the emergency terminal speed limiting device 43 to activate a safety device upon detecting acceleration or main rope breakage have also been proposed conventionally. However, all of these detect car acceleration or a signal that is similar thereto, and determine electrically whether a threshold level is exceeded, and do not function during power outages. It is not necessary to anticipate running away of the hoisting machine motor during power outages, but the probability that problems such as main rope breakage might occur is not zero.

In contrast to that, according to the anomalous acceleration detecting mechanism 44 according to Embodiment 1, the safety device 17, which applies a braking force directly to the car 8, can be activated mechanically even during power outages.

Furthermore, by using the anomalous acceleration detecting mechanism 44 according to Embodiment 1, the buffer stroke can be kept constant even if the rated speed of the car 8 is increased to greater than or equal to a given speed.

Figure 8:
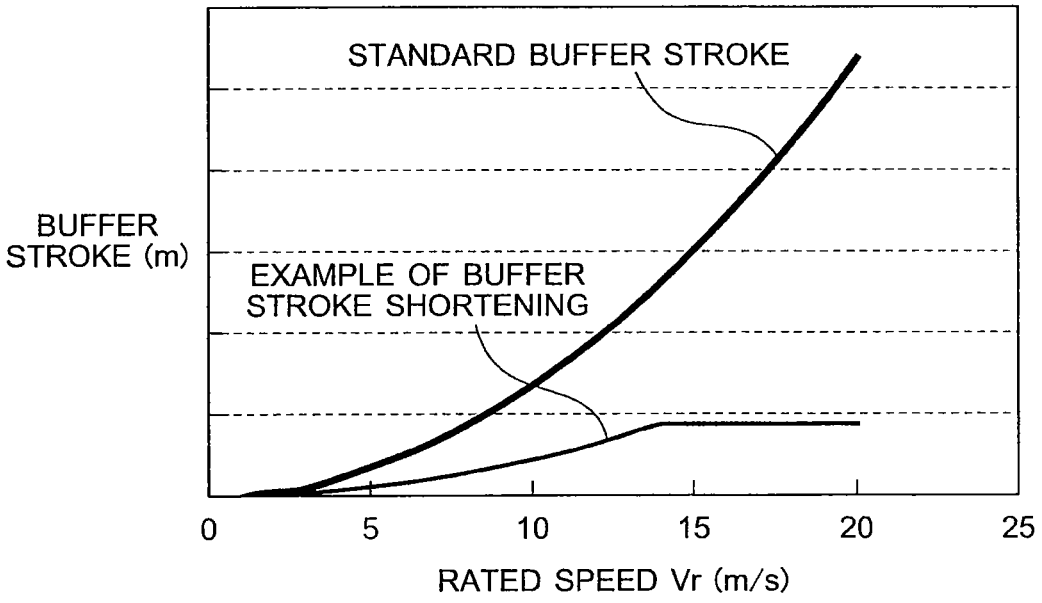
FIG. 8 is a graph that shows a relationship between rated speed and buffer stroke in the elevator apparatus in FIG. 1.

FIG. 8 is a graph that shows a relationship between rated speed and buffer stroke in the elevator apparatus in FIG. 1, and shows a comparison between a standard buffer stroke and an example of a buffer stroke that is shortened by the configuration according to Embodiment 1. As shown in FIG. 8, in the configuration according to Embodiment 1, the buffer stroke can be shortened amply while ensuring safety, and the buffer stroke can also be kept constant when the rated speed is greater than or equal to a given speed. Space saving can also be achieved in the hoistway 1 by shortening the buffer stroke.

Now, let V1 be the maximum impact speed when the car 8 reaches the upper surface of the car buffer 12 if excessive speed is detected and the braking apparatus 41 is activated by the emergency terminal speed limiting device 43 when the suspending means 7 that suspends the car 8 and the counterweight 9 is not broken. Let V2 be the maximum impact speed when the car 8 reaches the upper surface of the car buffer 12 if the safety device 17 is activated by the anomalous acceleration detecting mechanism 44 when the suspending means 7 is broken. Then, (1) the buffer stroke is determined by the larger of the impact speeds, V1 and V2.

Furthermore, (2) the acceleration $\alpha$ at which the anomalous acceleration detecting mechanism 44 is activated is set such that a relationship with acceleration $\beta$ is $\alpha>\beta$, where $\beta$ is determined by the total mass M of the car 8 (and the load mass thereon) plus the suspending means 7 plus the counterweight 9 (and the loaded weight thereon), and by the driving force T during running away of the hoisting machine motor (=M/T). In other words, the safety device 17 is designed so as not to be activated even if the car 8 runs away when the suspending means 9 is not broken.

Limitations on shortening of the buffer stroke are determined by allowing for (1) and (2) above.

The equivalent excessive speed detection level Vis can be set to any magnitude by adjusting the force Fs (N) that is required to activate the safety device 17 and the inertial mass Mt (kg) of the mass 22.

Figure 9:
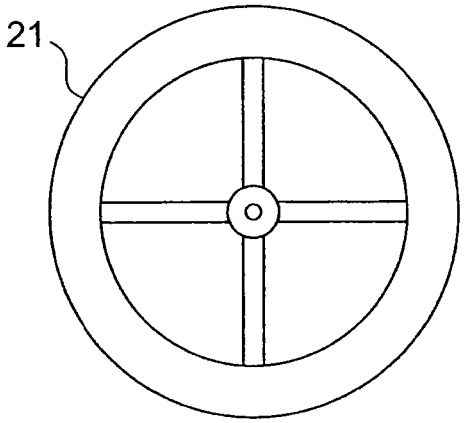
FIG. 9 is a front elevation that shows a tensioning sheave from FIG. 1.
Figure 10:
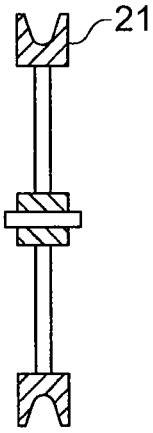
FIG. 10 is a cross section of the tensioning sheave in FIG. 9.
Figure 11:
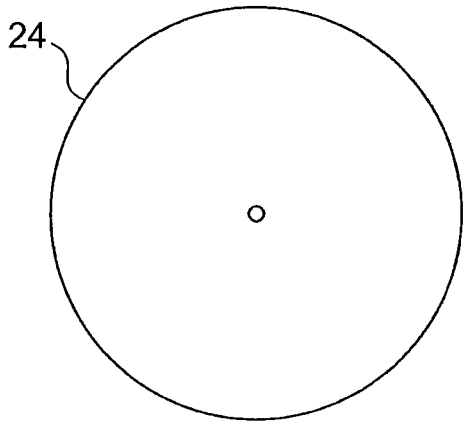
FIG. 11 is a front elevation that shows a tensioning sheave in which thickness is increased compared to the tensioning sheave in FIG. 9.
Figure 12:
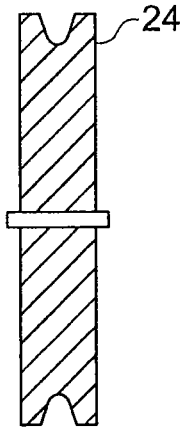
FIG. 12 is a cross section of the tensioning sheave in FIG. 11.

Methods for adjusting the inertial mass Mt of the mass 22 to an appropriate magnitude will now be explained. FIG. 9 is a front elevation that shows the tensioning sheave 21 from FIG. 1, and FIG. 10 is a cross section of the tensioning sheave 21 in FIG. 9. The inertial mass Mt can be adjusted by using a tensioning sheave 24 such as that shown in FIGS. 11 and 12, in which thickness is increased, for example, instead of this kind of tensioning sheave 21.

Figure 13:
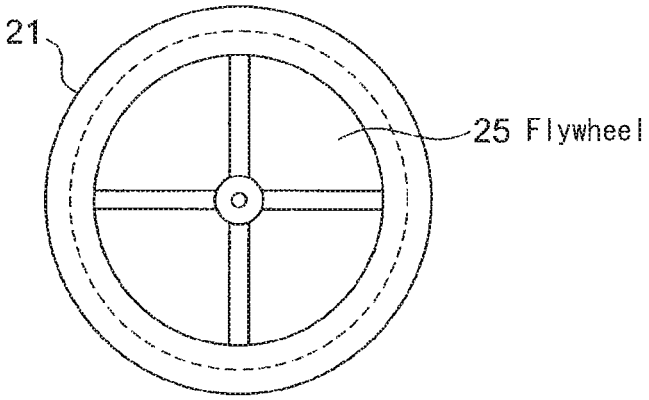
FIG. 13 is a front elevation that shows an example in which a flywheel is added to the tensioning sheave in FIG. 9.
Figure 14:
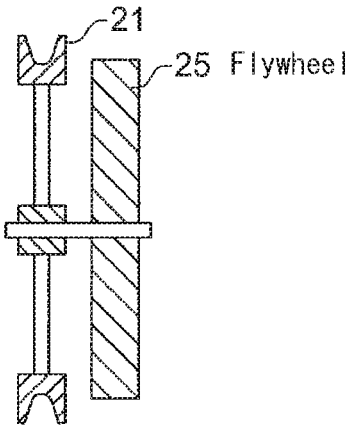
FIG. 14 is a cross section of the tensioning sheave and the flywheel in FIG. 13.

As shown in FIGS. 13 and 14, the inertial mass Mt can also be adjusted by adding a flywheel 25 that rotates coaxially with the tensioning sheave 21, for example.

Embodiment 2

Figure 15:
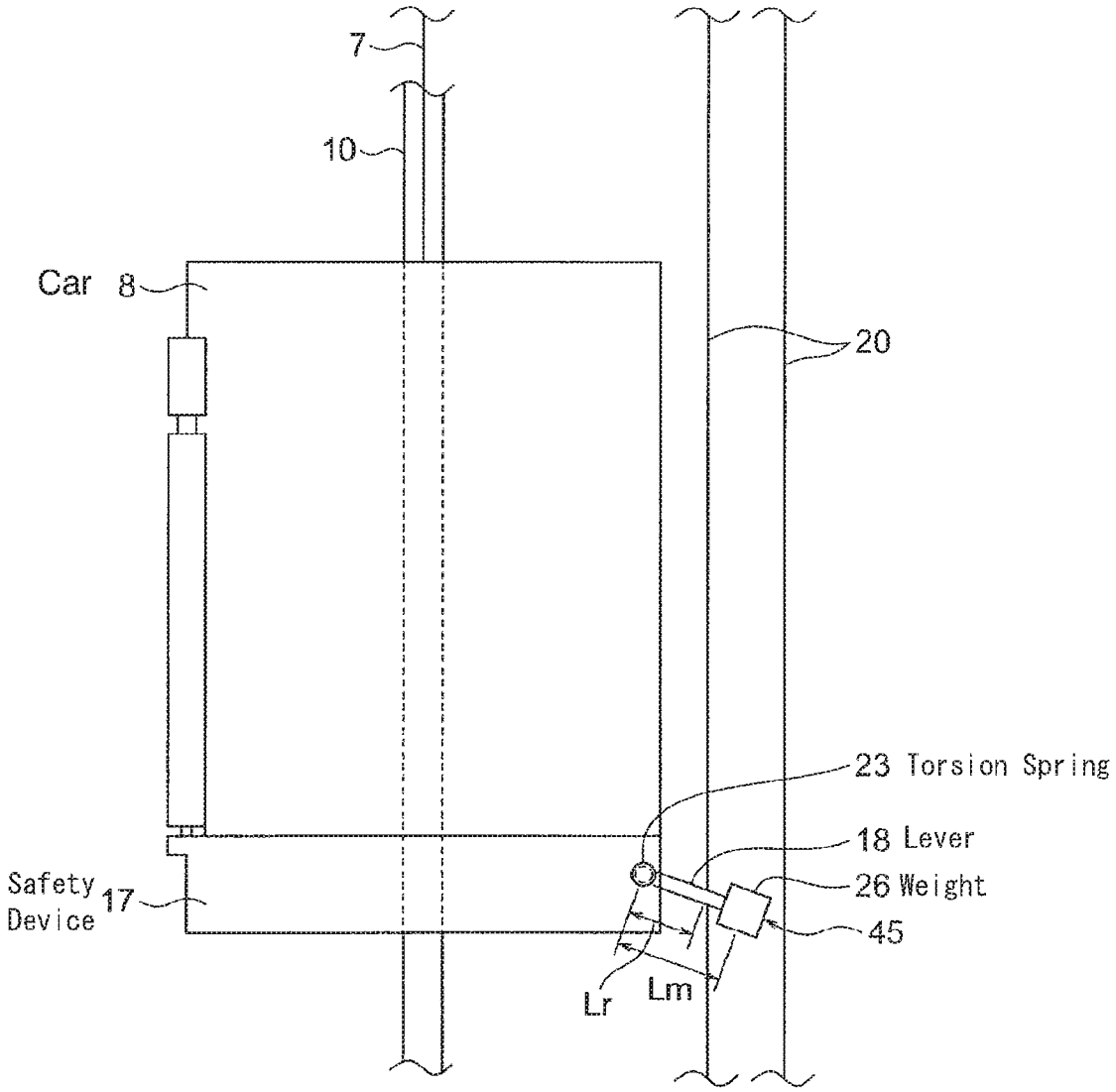
FIG. 15 is a configuration diagram that shows a car of an elevator apparatus according to Embodiment 2 of the present invention.

Next, FIG. 15 is a configuration diagram that shows a car 8 of an elevator apparatus according to Embodiment 2 of the present invention. In Embodiment 2, a weight (a mass) 26 of mass Mm (kg) is mounted onto a tip end of an activating lever 18. An anomalous acceleration detecting mechanism 45 according to Embodiment 2 includes a torsion spring 23 and the weight 26.

A length from a pivoting center of the activating lever 18 to a mounted position of a speed governor rope 20 is Lr (m), and a length to a center of gravity of the weight 26 is Lm (m). Inertial mass Mt (kg) of a speed governor 19, the speed governor rope 20, and a tensioning sheave 21 are extremely small compared to the mass Mm (kg) of the weight 26. The rest of the configuration is similar or identical to that of Embodiment 1.

Now, if the suspending means 7 breaks and the car 8 accelerates at an acceleration g ($m/s^2$), then the car 8 is subjected to an inertial force Fq (N) that has a magnitude of:

$$Fq=Mm\times(Lm/Lr)\times g$$

upward from the weight 26 at the mounted position of the speed governor rope 20 on the activating lever 18.

Figure 16:
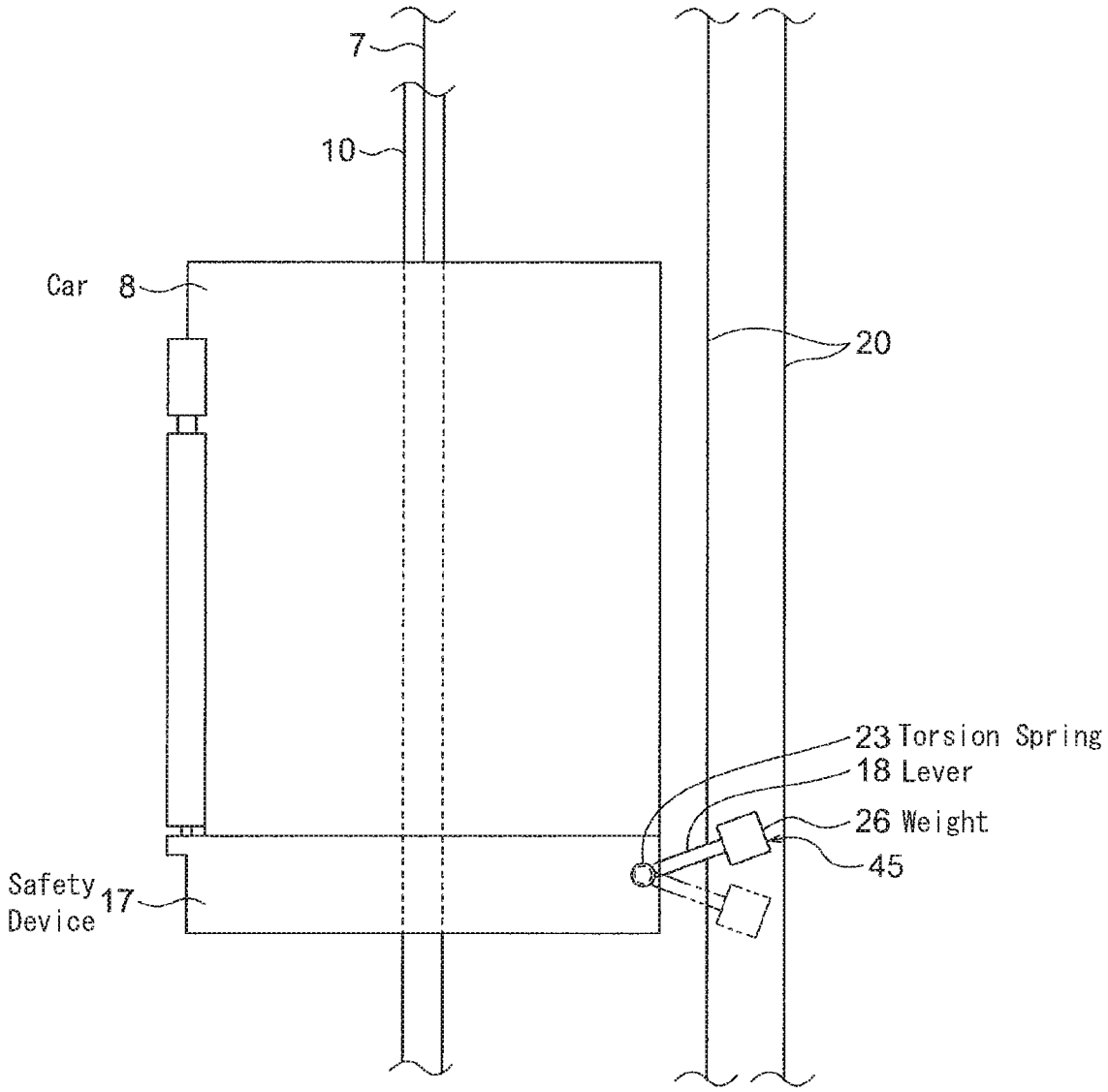
FIG. 16 is a configuration diagram that shows a state in which an activating lever from FIG. 15 is pivoted.

If this inertial force Fq (N) exceeds the force Fs (N) that is required to activate the safety device 17, i.e., if $$Fs<Mm\times(Lm/Lr)\times g,$$

then the activating lever 18 is pivoted counterclockwise as shown in FIG. 16, activating the safety device 17.

Thus, by adjusting the force Fs (N) that is required to activate the safety device 17, the mass Mm (kg) of the weight 26, the mounted position Lm (m) of the weight 26, etc., it becomes possible to activate the safety device 17 if the suspending means 7 breaks and the car 8 free-falls, even if the speed governor 19 does not detect a speed that is greater than or equal to the second excessive speed detection level Vtr. Consequently, the buffer stroke can be shortened amply, and space saving can be achieved in the hoistway 1 by a simple configuration without complicating the construction of the speed governor 19.

Moreover, in Embodiment 2, a case is shown in which the weight 26 is mounted to the activating lever 18 to which the speed governor rope 20 is mounted, but operation is similar or identical even if the speed governor rope 20 is not mounted.

In Embodiment 2, the inertial mass Mt is extremely small compared to the mass Mm, but the inertial mass Mt may also be enlarged to a certain extent, and the set value of the anomalous acceleration adjusted by combining the mass 22 according to Embodiment 1 and the weight 26 according to Embodiment 2.

In addition, the torsion spring 23 may also be omitted from the configuration according to Embodiment 2.

Embodiment 3

Figure 17:
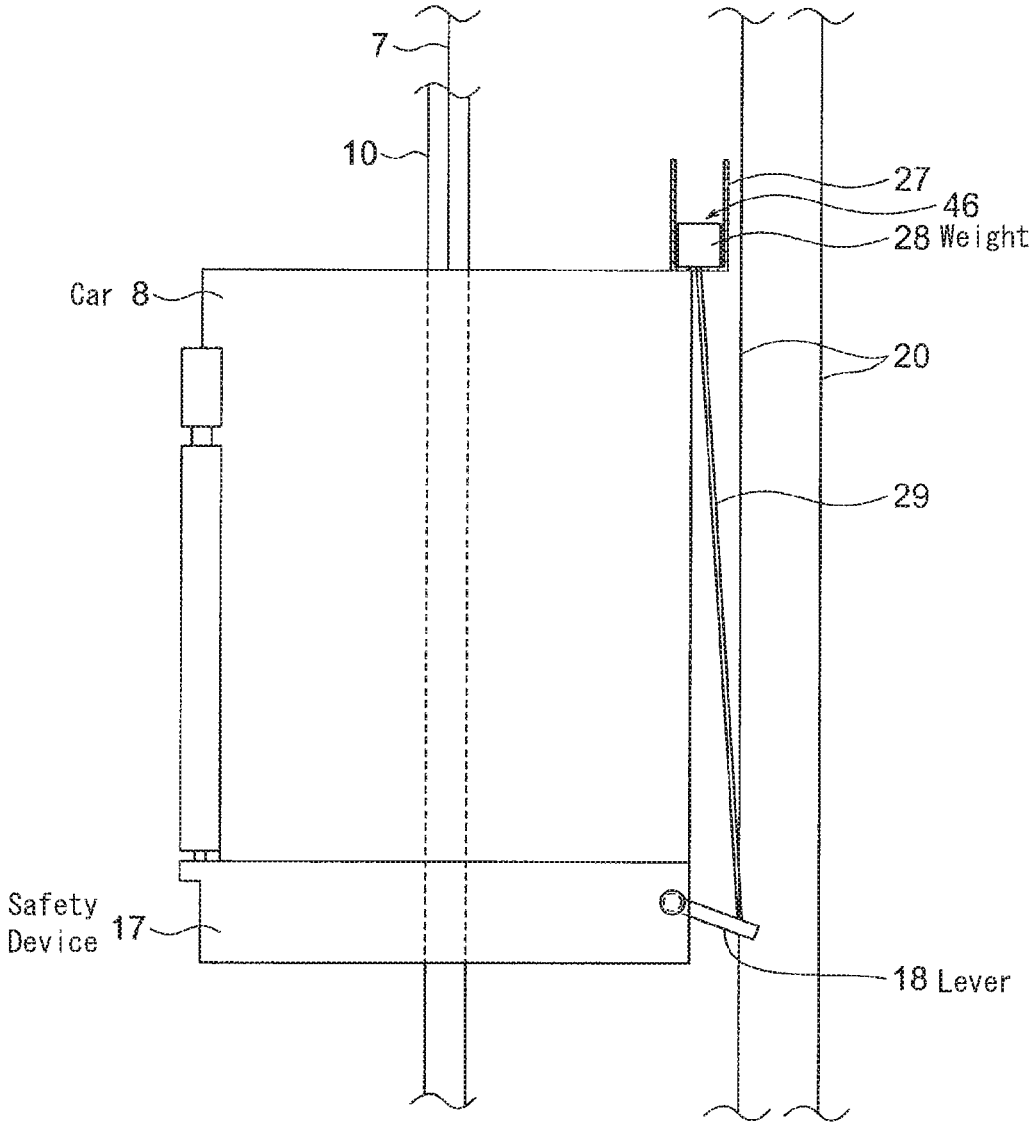
FIG. 17 is a configuration diagram that shows a car of an elevator apparatus according to Embodiment 3 of the present invention.
Figure 18:
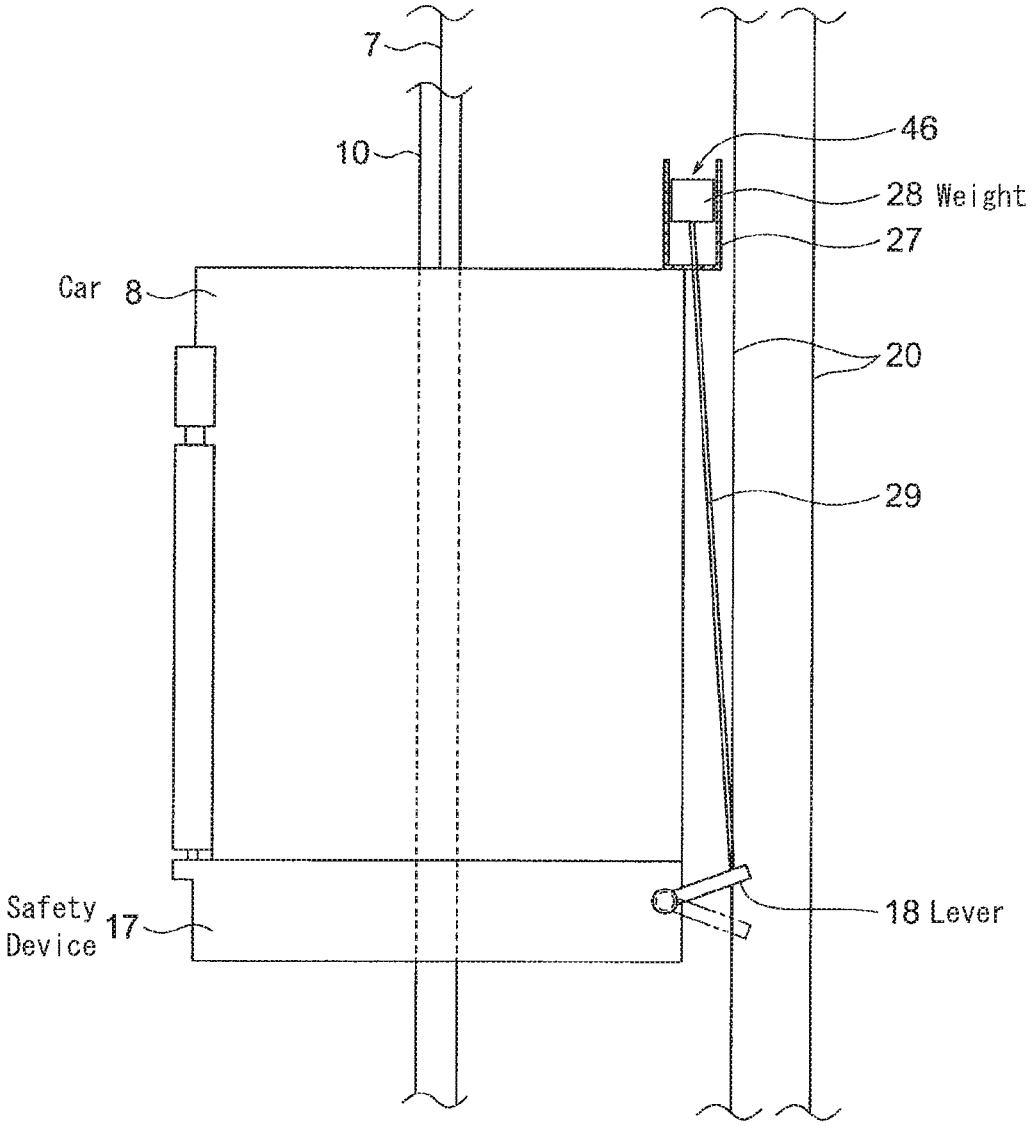
FIG. 18 is a configuration diagram that shows a state in which an activating lever from FIG. 17 is pivoted.

Next, FIG. 17 is a configuration diagram that shows a car 8 of an elevator apparatus according to Embodiment 3 of the present invention, and FIG. 18 is a configuration diagram that shows a state in which an activating lever 18 from FIG. 17 is pivoted. In the figures, a guiding body 27 is disposed on the car 8. A weight (a mass) 28 that is movable vertically along an inner wall surface of the guiding body 27 is inserted inside the guiding body 27.

The weight 28 is linked to the activating lever 18 by means of a linking rod (a linking body) 29. Inertial mass Mt (kg) of a speed governor 19, a speed governor rope 20, and a tensioning sheave 21 is extremely small compared to the mass Mm (kg) of the weight 28. An anomalous acceleration detecting mechanism 46 according to Embodiment 3 includes a torsion spring 23 and the weight 28. The rest of the configuration is similar or identical to that of Embodiment 1.

In an elevator apparatus of this kind, if the car 8 free-falls due to breakage of the suspending means 7, then the weight 28 applies an upward inertial force to the activating lever 18 by means of the linking rod 29, as shown in FIG. 18, thereby activating the safety device 17.

Thus, by adjusting the force Fs (N) that is required to activate the safety device 17, the mass Mm (kg) of the weight 28, etc., it becomes possible to activate the safety device 17 if the suspending means 7 breaks and the car 8 falls, even if the speed governor 19 does not detect a speed that is greater than or equal to the second excessive speed detection level Vtr. Consequently, the buffer stroke can be shortened amply, and space saving can be achieved in the hoistway 1 by a simple configuration without complicating the construction of the speed governor 19.

Moreover, in Embodiment 3, a case is shown in which the weight 28 is linked to the activating lever 18 to which the speed governor rope 20 is mounted, but operation is similar or identical even if the speed governor rope 20 is not mounted.

In Embodiment 3, the inertial mass Mt is extremely small compared to the mass Mm, but the inertial mass Mt may also be enlarged to a certain extent, and the set value of the anomalous acceleration adjusted by combining the mass 22 according to Embodiment 1 and the weight 28 according to Embodiment 3.

In addition, it is also possible to use the weight 28 according to Embodiment 3 and the weight 26 according to Embodiment 2 in combination.

Furthermore, because the force Fs that is required to activate the safety device 17 is adjusted, the torsion spring 23 can also be disposed or omitted in a similar or identical manner to that of Embodiment 2.

Embodiment 4

Figure 19:
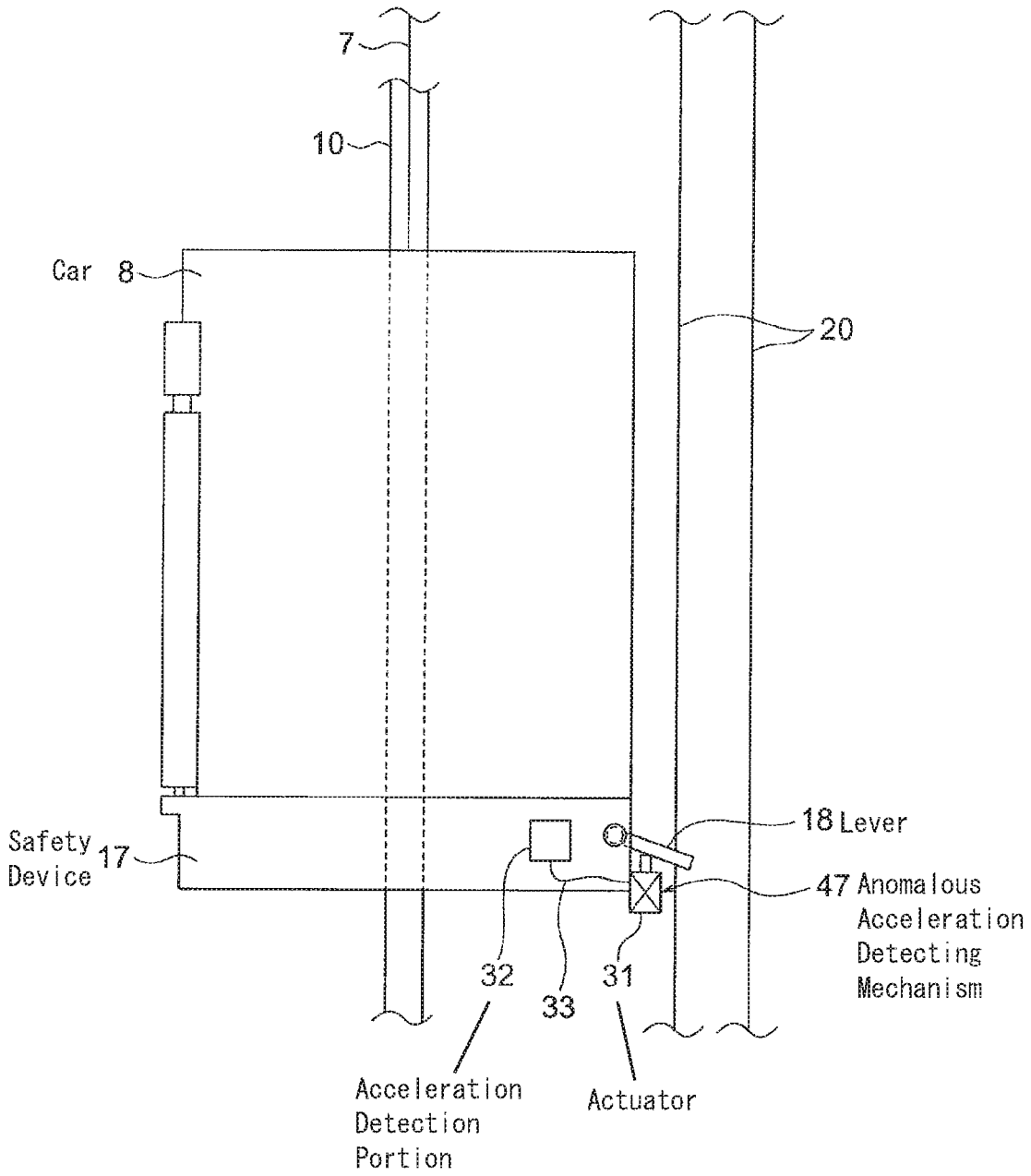
FIG. 19 is a configuration diagram that shows a car of an elevator apparatus according to Embodiment 4 of the present invention.
Figure 20:
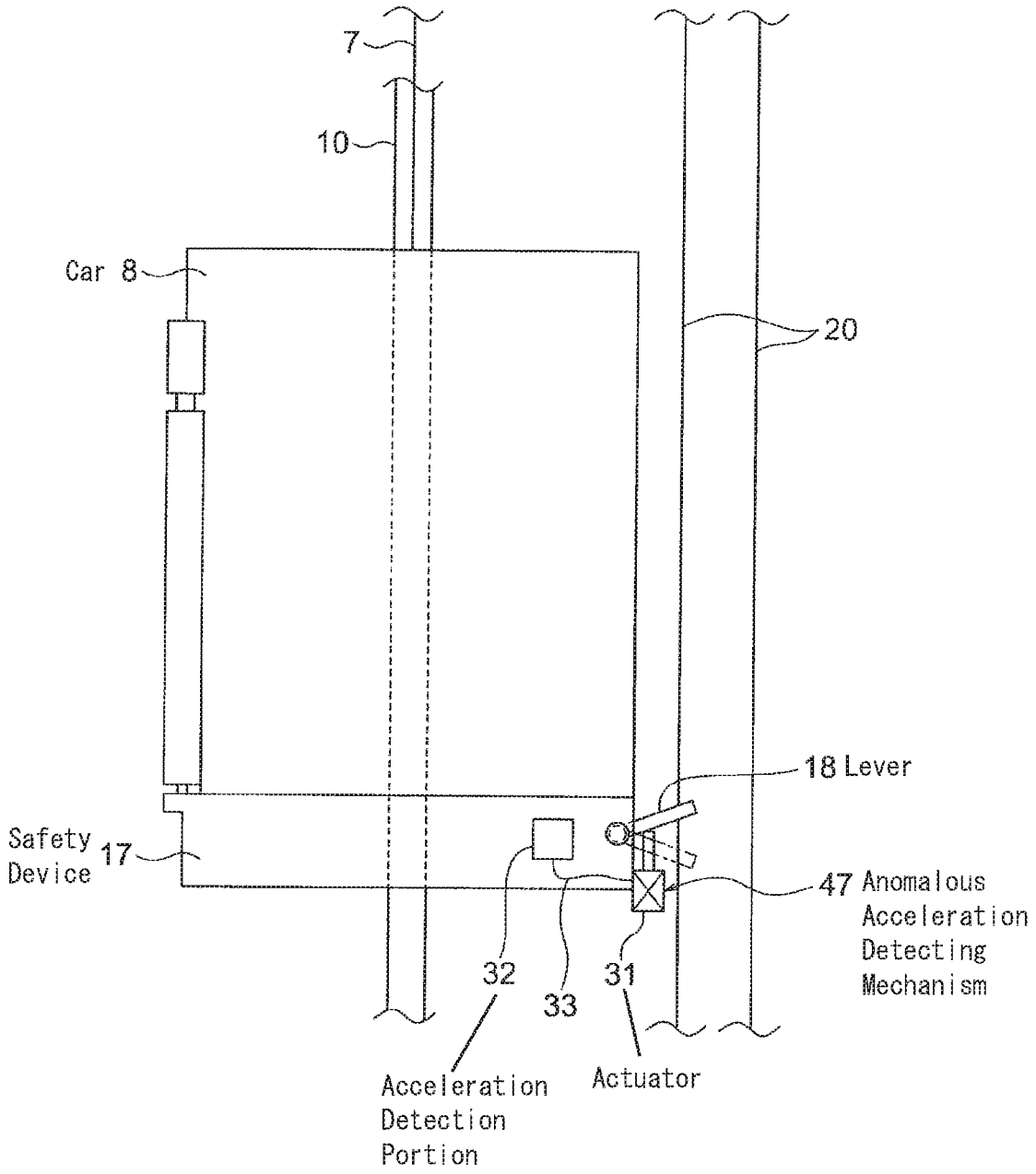
FIG. 20 is a configuration diagram that shows a state in which an activating lever from FIG. 19 is pivoted.

Next, FIG. 19 is a configuration diagram that shows a car 8 of an elevator apparatus according to Embodiment 4 of the present invention, and FIG. 20 is a configuration diagram that shows a state in which an activating lever 18 from FIG. 19 is pivoted. In the figures, mounted onto a frame body of a safety device 17 are: an actuator 31 that operates the activating lever 18; and an acceleration detecting portion 32 that controls the actuator 31 in response to acceleration of the car 8. The acceleration detecting portion 32 is connected to the actuator 31 by means of a signal wire 33.

An acceleration sensor is disposed on the acceleration detecting portion 32, and an operating command signal is output to the actuator 31 when acceleration of the car 8 exceeds a preset set value. The actuator 31 pivots the activating lever 18 to activate the safety device 17 when the operating command signal is received. An anomalous acceleration detecting mechanism 47 according to Embodiment 4 includes the actuator 31, the acceleration detecting portion 32, and the signal wire 33. Overall configuration of the elevator apparatus is similar or identical to that of Embodiment 1.

The set value of the acceleration in the acceleration detecting portion 32 is less than or equal to acceleration g (9.8 $m/s^2$) of the car 8 during falling due to breakage of the suspending means 7. Thus, if the suspending means 7 breaks and the car 8 accelerates at gravitational acceleration, the safety apparatus 17 can be activated by moving the actuator 31 as shown in FIG. 20.

The set value of the acceleration in the acceleration detecting portion 32 is set to a value that is higher than acceleration during normal operation such that rapid acceleration of the car 8 due to an anomaly in the operation controlling apparatus 5 can also be detected, and is also set to a value that is higher than deceleration rate when performing urgent stopping (also known as an "E-Stop") due to a power outage during ascent of the car 8. Moreover, such anomaly detecting acceleration control settings can also be applied to Embodiments 1 through 3.

Using an elevator apparatus of this kind, it also becomes possible to activate the safety device 17 if the suspending means 7 breaks and the car 8 free-falls, even if the speed governor 19 does not detect a speed that is greater than or equal to the second excessive speed detection level Vtr. Consequently, the buffer stroke can be shortened amply, and space saving can be achieved in the hoistway 1 by a simple configuration without complicating the construction of the speed governor 19.

Moreover, in Embodiment 4, the acceleration detecting portion 32 is mounted onto the frame body of the safety device 17, but may also be mounted onto the car 8 or other equipment, etc., that is fixed to the car 8.

In Embodiments 1 and 2, a torsion spring 23 is used in order to adjust the force Fs that is required to activate the safety device 17, but a spring, etc., does not necessarily have to be added, provided that an adequate force Fs can be achieved and, if added, is not limited to a torsion spring.

In addition, the braking apparatus 41 that applies the braking force to the car 8 by means of the suspending means 7 is not limited to a hoisting machine brake, and may also be a type that grips the suspending means 7 directly (a "rope brake"), for example.

Furthermore, in FIG. 1, a one-to-one (1:1) roping elevator apparatus is shown, but the roping method is not limited thereto, and the present invention can also be applied to two-to-one (2:1) roping elevator apparatuses, for example.

The present invention can also be applied to machine-roomless elevators that do not have a machine room 2, or to various other types of elevator apparatus, etc.

The invention claimed is:

1. An elevator apparatus comprising:

a hoisting machine comprising a driving sheave;

a suspending means that is wound around the driving sheave;

a car that is suspended by the suspending means so as to be raised and lowered by the hoisting machine;

a braking apparatus that applies a braking force to the car by means of the suspending means;

an excessive speed monitoring portion in which is set an excessive speed detection level that changes in response to car position, and that makes the braking apparatus perform a braking operation when car speed reaches the excessive speed detection level;

a safety device that is disposed on the car; and an anomalous acceleration detecting mechanism that activates the safety device if acceleration that exceeds a preset set value arises in the car, wherein the anomalous acceleration detecting mechanism comprises a mass that operates in connection with movement of the car, and activates the safety device using an inertial force that is generated by the mass if the acceleration that exceeds the set value arises in the car.

2. An elevator apparatus according to claim 1, wherein the excessive speed monitoring portion is an emergency terminal speed limiting device in which is set an excessive speed detection level that changes steplessly relative to position inside a car deceleration zone of a hoistway terminal portion.

3. An elevator apparatus according to claim 1, wherein the mass comprises:

a rope that is arranged in a loop inside a hoistway; and a sheave around which the rope is wound.

4. An elevator apparatus according to claim 3, further comprising a speed governor that detects an overspeed of the car, the sheave around which the rope is wound being a speed governor sheave that is disposed on the speed governor, and the rope being a speed governor rope.

5. An elevator apparatus according to claim 1, wherein:

$$Mt \times \alpha > Fs,$$

where Fs is a force that is required to activate the safety device, $\alpha$ is the set value, and Mt is inertial mass of the mass.

* * * * *